United States Patent [19]

Schimko

[11] Patent Number: 5,020,341

[45] Date of Patent: Jun. 4, 1991

[54] BRAKING DEVICE ON THE THREAD GUIDE BOX OF A FLAT BED KNITTING MACHINE

[75] Inventor: Reinhold Schimko, Westhausen, Fed. Rep. of Germany

[73] Assignee: Universal Maschinenfabrik Dr. Rudolf Schieber GmbH, Westhausen, Fed. Rep. of Germany

[21] Appl. No.: 469,569

[22] PCT Filed: Sep. 15, 1988

[86] PCT No.: PCT/EP88/00845

§ 371 Date: Mar. 29, 1990

§ 102(e) Date: Mar. 29, 1990

[87] PCT Pub. No.: WO89/02946

PCT Pub. Date: Apr. 6, 1989

[30] Foreign Application Priority Data

Sep. 30, 1987 [DE] Fed. Rep. of Germany ..... 3733121

[51] Int. Cl.[5] ..... D04B 15/48

[52] U.S. Cl. ..... 66/126 R

[58] Field of Search ..... 66/60 R, 126 R, 127, 66/130

[56] References Cited

U.S. PATENT DOCUMENTS 4,738,124 4/1988 Stoll et al. ..... 66/127

FOREIGN PATENT DOCUMENTS 267777 11/1913 Fed. Rep. of Germany .... 66/126 R
719964 4/1942 Fed. Rep. of Germany .... 66/126 R
3641182 2/1988 Fed. Rep. of Germany .
599930 10/1925 France ..... 66/127
780320 1/1935 France ..... 66/126 R

*Primary Examiner*—Wm. Carter Reynolds
*Attorney, Agent, or Firm*—Limbach, Limbach & Sutton

[57] ABSTRACT

The thread guide box (1) of a flat-bed knitting machine is slidingly mounted on a sliding rail (2) extending along the needle beds. The box is driven in both directions of motion of the lock carriage, together with the latter, by a driving pin (4) arranged on the lock carriage. To ensure uniform, constant braking of the thread guide box (1), at least one permanent magnet (6) is mounted on the latter in the region of the sliding rail (2) and has a fixed air gap (7) for the magnetically conducting sliding rail (2).

3 Claims, 1 Drawing Sheet

BRAKING DEVICE ON THE THREAD GUIDE BOX OF A FLAT BED KNITTING MACHINE

DESCRIPTION

Figure 1:
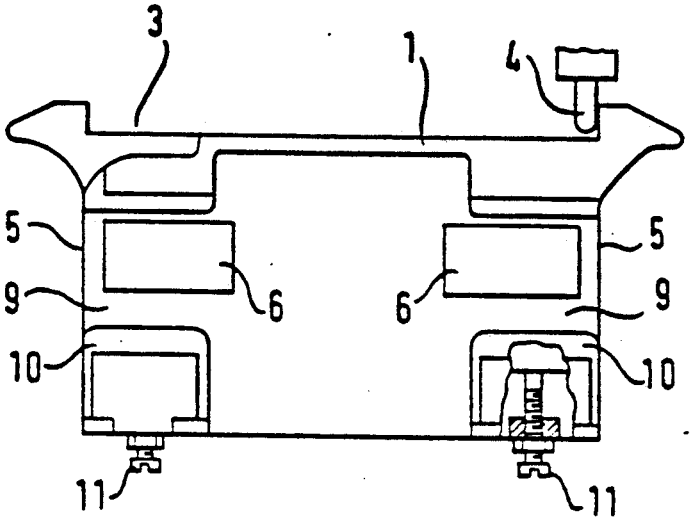

The invention relates to a braking device on the thread guide box of a flat bed knitting machine which is slide mounted on a slide rail extending along the needle beds and which can be moved along the slide rail by the pin carriage in both directions of travel of the carriage in each case by a driving pin fitted onto the pin carriage.

As is known from DE-A-267777, DE-A-719964 or DE-A-2459693, a thread required to be processed on a flat bed knitting machine is fed to the working needles of the flat bed knitting machine coming from a spool via a small thread guide pulley in the conventional manner. The small thread guide pulley is attached to the thread guide box, which sits on the slide rail and is taken along by the driving pin in both directions of travel of the carriage.

The known complete thread guide box with thread guide pulley is always controlled so as to trail the knitting pin, where the size of the transverse movement of the knitting pin is determined. The thread guide box is braked with a known braking device on the thread guide box in the form of spring loaded braking wedges, where it may or may not be possible to control the braking force depending on the design, known via the publications Melliand Textilberichte No. 6/1955, p. 634 to p. 643 and Wirkerei-und Strickeri-Technik, Coburg, Dec. 1956, p. 20 to p. 23, so that now the thread guide box will always travel at constant speed. Pressure springs which cannot subsequently be adjusted will for example be mounted on the braking wedges, if it is required for the braking force to remain constant without it being possible to affect it.

The braking wedges are set up to approximately 0.1 mm on the contact surface of the slide rail by means of screws. The gaps between the screws and the brake wedges contain pressure springs, which press the brake wedges onto the contact surface of the slide rail and thereby produce the desired slide braking action.

The dynamic braking force, which in this case cannot be affected, is nevertheless subject to the tolerances of the pressure springs, which as a rule can vary by up to 30%. Should it be possible to influence the dynamic braking force by subsequent adjustment, then there will be the danger of it being set incorrectly by a non-expert and therefore making subsequent damage unavoidable.

The object of the invention is to provide a braking device of the type described above, which avoids the disadvantages of known braking devices and guarantees a uniform and constant dynamic braking action on the thread guide box.

This problem is solved by the invention in that at least one permanent magnet is fitted to the thread guide box in the area of the slide rail, which has a predetermined air gap with the magnetically conducting slide rail. The designer will therefore be able to determine the dynamic braking force positively and make it invariable during operation by suitably designing the permanent magnet and the air gap so that it will remain uniform and constant during operation.

Two permanent magnets are provided to advantage adjacent to the front sides of the thread guide box and aligned with respect to the central longitudinal axis of the slide rail. This produces a particularly uniform dynamic braking force during operation remaining permanently constant.

The slide rail preferably has a dovetail shaped cross-section, whereas the thread guide box has longitudinal guide slots with trapezoidal cross-sections matching the cross-section of the slide rail. This will lead to a particularly simple construction, easy to manufacture with little maintenance as well as evenly braked guidance of the thread guide box.

Figure 2:
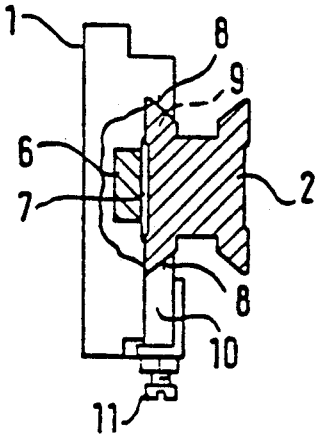

Adjustable guide wedges are favourably fitted in the area at least of one of the side walls of the longitudinal guide slots on the thread guide box, effectively to guide wedges adjacent to the front sides of the thread guide box. In this way it will be possible to achieve a fine setting for the guide of the thread guide box with the appropriate effect on the basic setting of the dynamic braking force between the thread guide box and the slide rail provided. The invention is described in greater detail below in a design example with reference to the drawing. Where:

FIG. 1 shows a side view, partially in section, of a preferred form of the design of the thread guide box with a braking mechanism according to the invention, and FIG. 2 a front view of the thread guide box in FIG. 2 partially in section, with the associated slide rail.

The thread guide box 1 shown schematically in the drawing is mounted on a guide rail 2 extending along the needle beds of a flat bed knitting machine not shown in a manner which allows it to slide. It has a longitudinal recess 3 on its top side. A carrier bolt 4 fitted to the bolt carriage not shown will in each case be engaged in one of the side walls of the longitudinal recess 3, so that the thread guide box 1 with the attached little thread guide pulley not shown can in each case be driven in either direction of travel of the carriage of the bolt carriage along the slide rail 2.

There are two permanent magnets attached near the slide rail 2 and adjacent to the front sides 5 of the thread guide box 1, also aligned with respect to the central longitudinal axis of the slide rail, which will in each case have a fixed air gap 7 relative to the magnetically conducting slide rail.

The slide rail 2 has a dovetail shaped cros-section and two contact surfaces 8. Simple longitudinal guide rail slots 9 with trapezoidal cross-section matched to the cross-section of the guide rail 2 are provided on the thread guide box 1 in the region of its front faces 5 and of the permanent magnets 6.

A guide wedge 10 with associated support is in each case provided in the region of the side wall of the longitudinal guide slot 9 for the case where not only single longitudinal guide slots are constructed, which can be adjusted relative to the corresponding contact surface 8 of the slide rail 2 by means of a screw 11. Even this expanded construction of the guide and braking mechanisn still means an obvious simplification relative to the known braking mechanisms with pressure springs and brake wedges.

The permanent magnet 6 transmit their magnetic force from the thread guide box 1 to the magnetically conducting guide rail 2 and therefore allow this force to act as uniform and constant dynamic braking force.

I claim:

1. Braking device on the thread guide box (1) of a flat bed knitting machine which is mounted on a slide rail (2) extending along the needle beds and which can be driven along the slide rail (2) in either direction of travel of the carriage of the bolt carriage in each case by a carrier bolt (4) fitted to the bolt carriage, characterised in that at least one permanent magnet (6) is fitted onto the thread guide box (1) near the slide rail (2), which has a fixed air gap (7) relative to the magnetically conducting slide rail (2).

2. Braking device as in claim 1, characterised in that the slide rail (2) has a dovetail shaped cross-section and the thread guide box (1) has longitudinal guide slots (9) with trapeazoidal shaped cross-section matching the cross-section of the slide rail (2).

3. Braking device as in claim 2, characterised in that an adjustable guide wedge (10) is fitted near at least one of the side walls of the longitudinal guide slots (9), the thread guide box (1).

* * * * *